United States Patent [19]

Chiappetta et al.

[11] 4,120,145

[45] Oct. 17, 1978

[54] LUBRICATED PLASTIC IMPREGNATED WIRE ROPE

[75] Inventors: Ferdinand Chiappetta; Fred Edgar Dykeman, both of Kenosha; Paul Allen Turner, Burlington, all of Wis.

[73] Assignee: AMSTED Industries Incorporated, Chicago, Ill.

[21] Appl. No.: 821,574

[22] Filed: Aug. 3, 1977

[51] Int. Cl.[2] ..... D07B 1/06; D07B 1/16

[52] U.S. Cl. ..... 57/149; 57/153; 57/162; 57/164

[58] Field of Search ..... 57/140 C, 144, 149, 57/153, 160, 162, 164, 7, 138

[56] References Cited

U.S. PATENT DOCUMENTS

| | | | |
|---|---|---|---|
| 2,181,475 | 11/1939 | Bourdon | 57/149 X |
| 2,480,005 | 8/1949 | Ewell | 57/149 X |
| 3,131,530 | 5/1964 | Dietz | 57/149 |
| 3,195,299 | 7/1965 | Dietz | 57/149 |
| 3,318,082 | 5/1967 | Riggs | 57/149 |
| 3,425,207 | 2/1969 | Campbell | 57/149 X |
| 3,705,489 | 12/1972 | Smollinger | 57/153 X |
| 3,800,522 | 4/1974 | Hughes et al. | 57/162 X |
| 3,824,777 | 7/1974 | Riggs | 57/149 |
| 3,874,158 | 4/1975 | Chiappetta | 57/153 X |
| 3,979,896 | 9/1976 | Klett et al. | 57/162 X |

*Primary Examiner*—Donald Watkins
*Attorney, Agent, or Firm*—Fred P. Kostka

[57] ABSTRACT

A wire rope, and method of making same, is provided wherein the wire core is lubricated with a heavy viscous lubricant and impregnated with thermoplastic material. The wire rope strands are embedded in the thermoplastic material which holds these strands in a spaced relationship from the core and from each other.

19 Claims, 4 Drawing Figures

LUBRICATED PLASTIC IMPREGNATED WIRE ROPE

BACKGROUND AND SUMMARY OF THE INVENTION

This invention relates to wire rope and a method of making wire rope. It is more particularly concerned with plastic impregnation of a lubricated wire rope.

Various methods are known for impregnating stranded wire rope with load-bearing plastic material in order to reduce contact stress between the strands of the rope, and improve load sharing between the strands. The plastic impregnation also serves to trap lubricant within the rope thereby improving fatigue life and providing a barrier against the ingress of abrasive and corrosive elements into the inner rope structure.

The present methods employed for the plastic impregnation of wire rope utilize dies which extrude plastic material around the rope, the diameter of the extruded plastic being nominally equal to that of the rope to be impregnated. These methods are satisfactory. However, the multiplicity of wire rope sizes, constructions and tolerances requires a broad and expensive range of tooling to assure proper finished rope diameter control. In many wire rope applications, tolerance variations are not critical. In those applications, one set of tools may be utilized on a range of rope constructions of the same diameter. However, on applications where the finished rope diameter is critical, individual tooling by rope size and construction may be required.

By the present invention a new and improved plastic impregnated wire rope and method for making the rope is proposed which will provide for more economic manufacture.

This is accomplished generally by providing a wire rope comprising generally a core containing a lubricant encapsulated by a generally cylindrical plastic jacket of greater diameter than the core and a plurality of strands laid about and embedded in said plastic jacket to provide a wire rope of a predetermined outer diameter with the plastic jacket being disposed between the strands and the outer diameter of the plastic jacket being displaced outwardly of the core and inwardly of the outer diameter of the rope. It should be noted that this rope may be constructed using a standard sized wire core and standard sized strands to produce a rope having a standard outer diameter.

In one method of making the rope the core is provided with a lubricant in the usual manner. The core is then impregnated with a thermoplastic material to provide a generally cylindrical plastic jacket of a predetermined diameter greater than the core. Thereafter, a plurality of strands is laid about the jacket, and the strands are forced radially inwardly into the jacket to form a rope of predetermined outer diameter. The strands are embedded in the plastic jacket which is flowably displaced outwardly between the strands to a location inwardly of the predetermined outer diameter of the rope.

The strands may either be embedded in the jacket solely by the application of a radially inward force or by heating the thermoplastic material prior to laying the strands about the jacket and forcing the strands radially inwardly.

DESCRIPTION OF THE PREFERRED EMBODIMENTS

Figure 1:
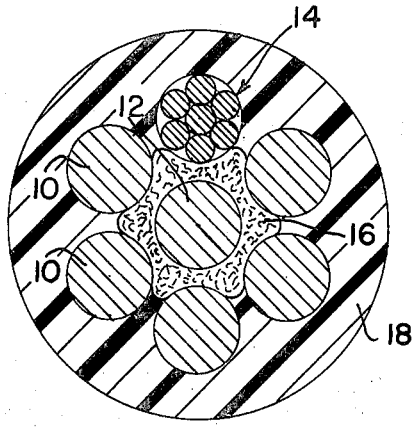
FIG. 1 is a cross-sectional view of a lubricated, impregnated and jacketed core produced according to the method of the present invention.

Referring now to FIG. 1, an independent wire rope core is shown wherein outer strands 10 are wound about center strand 12. The strands 10 and 12 have been illustrated as solid wires for simplicity, but it is understood that the strands 10 and 12 are composed of a plurality of wires laid about a wire core as shown at 14.

According to the present invention, the wire rope may be constructed with a wire strand core. In the case of a wire strand core, the wire rope core formed by strands 10 and 12 is replaced by a single strand composed of a plurality of wires laid about a wire core.

The wire strand or independent wire rope core is lubricated with a heavy viscous lubricant 16. The core is then impregnated and surrounded by a jacket 18 of a thermoplastic material such as polypropylene or any other thermoplastic material of good compressive strength. The jacket 18 thoroughly encapsulates the core and fills the interstices between the strands of the core. The outside diameter of the jacket 18 exceeds the outside diameter of the core.

Figure 2:
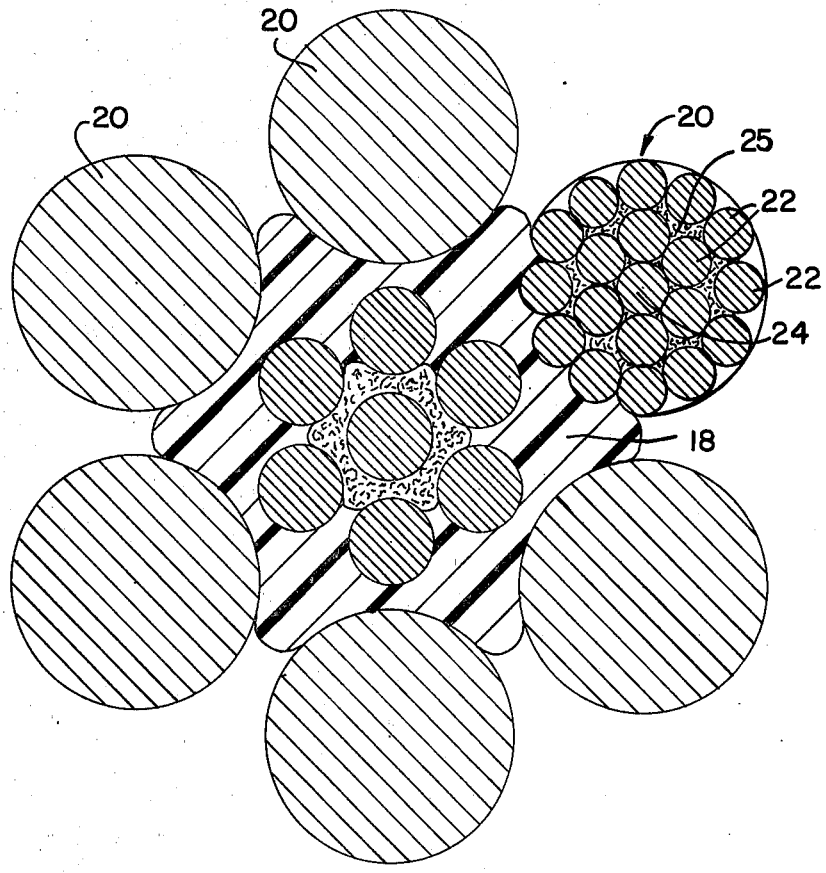
FIG. 2 is a cross-sectional view of the jacketed core of FIG. 1 after having had a typical number of strands laid around it at an intermediate step of the method of one embodiment of the invention.

FIG. 2 shows the jacketed core of FIG. 1 after having had a typical number of strands 20 wound about it in accordance with the method of one embodiment of the invention. In this case there are six strands 20, but a wide range of numbers of strands may be used to assemble a rope as is well known in the art. Each strand 20 is comprised of a plurality of individual wires 22 wound about an individual wire core 24. Since each of the strands 20 is substantially identical to the other strands 20, only one has been illustrated in detail. Again, the number of wires 22 and 24 in each strand 20 has been illustrated as nineteen, but a wide range of numbers of wires may be used as is well known in the art. The strands 20 may also be lubricated with a heavy viscous lubricant 25.

According to the method of one embodiment of the invention, wire strands 20 are helically laid around the jacket 18 of the core a shown in FIG. 2. The assembly is then subjected to any cold-forming process known in the art, such as roller compacting or swaging, to reduce the diameter of the rope. This cold-forming process causes the strands 20 to be forced radially inwardly into the jacket 18, causing the thermoplastic material of jacket 18 to cold flow radially outwardly to fill the interstices between the core and strands 20 and between the strands 20.

Figure 3:
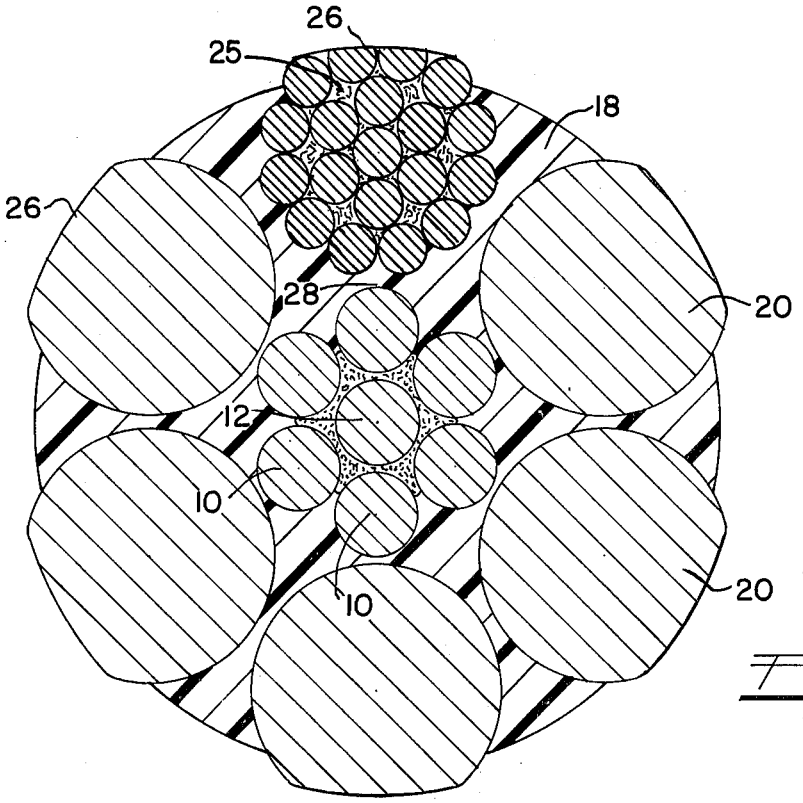
FIG. 3 is a cross-sectional view of a wire rope in accordance with one embodiment of the invention.

FIG. 3 shows the finished rope after the diameter reducing process described above. The wires or strands 10 and 12 of the core have been illustrated as solid wires for simplicity, but it is understood that the core can be either a wire strand or an independent wire rope core as described above. Since each of the strands 20 is substantially identical to the other stands 20, only one has been illustrated in detail. Each strand 20 is comprised of a plurality of individual wires 22 wound about an individual wire core 24.

The crown wires of the rope have been deformed slightly by the forces exerted on them during the diameter reducing process as shown at 26. The crown wires of a rope or of a strand are the wires which collectively define the outside diameter of the rope or strand. The deformed surface of the crown wires of the rope now lie substantially in a cylindrical surface which defines the outside diameter of the rope. However, the majority of each strand 20 retains its substantially round geometry. The geometry of the core and each of its wires of strands 10 and 12 remains unchanged from its origianl round condition.

The strands 20 have been forced into the jacket 18 but not into contact with the strands or wires 10 of the core. Thus the thermoplastic material of the jacket 18 holds the strands 20 in a spaced relationship from the core as at 28. Also, the thermoplastic material of the jacket 18 has flowed radially outwardly between the strands 20 and therefore holds the strands 20 in a spaced relationship from other strands 20. The thermoplastic material also encapsulates the majority of strands 20 and flows radially inwardly between the crown wires of the strands 20 thereby minimizing the opportunity for the lubricant 25 to escape from the strands 20. It is also important to note that the thermoplastic material of jacket 18 which has flowed radially outwardly between strands 20 terminates at a point less than the outside diameter of the rope.

The finished rope preferably has an outside diameter of greater than 0.985 (C + 2S) and less than 1.03 (C + 2S); where C is the outside diameter of the wire core (not including the jacket 18), and S in the outside diameter of one of the strands 20 (before being partially deformed by the diameter reducing process).

According to another embodiment of the method of the invention, the lubricated, impregnated and jacketed core shown in FIG. 1 is preheated before strands 20 are helically laid about the core. Immediately after the strands 20 are laid about the core, the assembly is closed through a die of a specified inside diameter to complete the assembly of the rope. The inside diameter of the die must be less than (J + 2S); where J is the outside diameter of the jacket, and S is the outside diameter of one of the strands. As the assembly passes through the die, the strands 20 are forced radially inwardly into jacket 18, causing the thermoplastic material of jacket 18 to flow radially outwardly to fill interstices between the core and strands 20 and between the strands 20.

Figure 4:
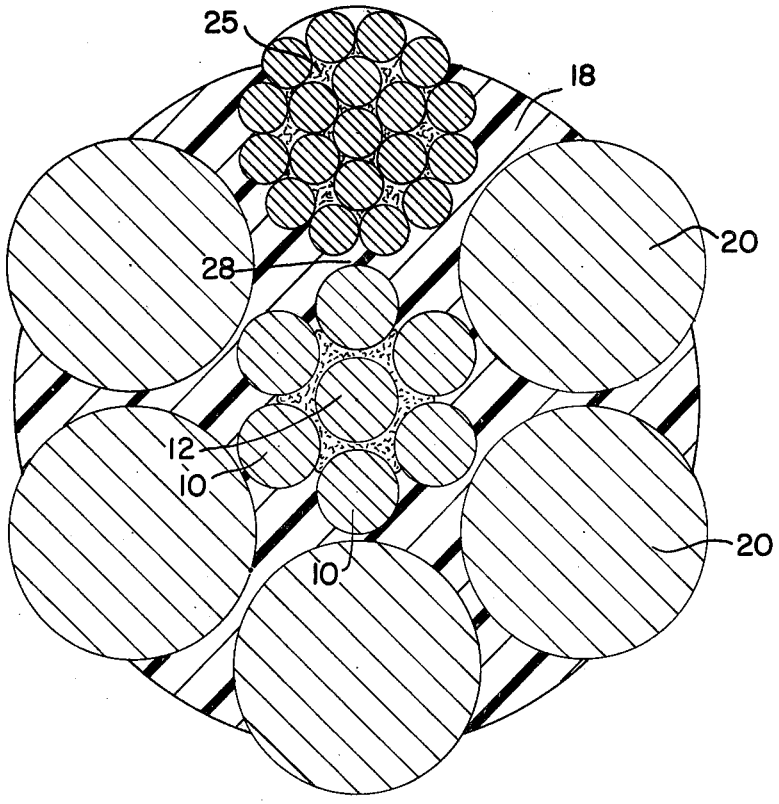
FIG. 4 is a cross-sectional view of a wire rope in accordance with another embodiment of the invention.

FIG. 4 shows a finished rope produced by the second embodiment of the method of the invention. Again, the wires or strands 10 and 12 of the core have been illustrated as solid wires for simplicity, but it is understood that the core can be either a wire strand or an independent wire rope core as described above. Since each of the strands 20 is substantially identical to the other strands 20, only one has been shown in detail.

The wire rope of FIG. 4 differs from that of FIG. 3 only in that the crown wires of strands 20 have not been deformed. This is due to the fact that the forces required to move the strands 20 radially into the heated jacket 18 are much lower than those required to produce the rope of FIG. 3. Therefore, in the wire rope of FIG. 4, the core and the strands all retain their original round shape.

As in FIG. 3, the wire rope of FIG. 4 has been closed so that the strands 20 do not contact the strands or wires 10 of the core. Thus the thermoplastic material of the jacket 18 holds the strands 20 in a spaced relationship from the core as at 28. Also, the thermoplastic material of the jacket 18 has flowed radially outwardly between strands 20, encapsulating the majority of strands 20 and holding the strands 20 in a spaced relationship from other strands 20. It is also important to note that the thermoplastic material of jacket 18 which has flowed radially outwardly between the strands 20 terminates at a point less than the outside diameter of the rope.

The outside diameter of the finished rope is determined by the inside diameter of the die through which the rope was closed. Preferably, the die has an inside diameter of greater than 0.985 (C + 2S) and less than 1.03 (C + 2S); where C is the outside diameter of the wire core (not including the jacket 18), and S is the outside diameter of one of the strands 20. It is possible for a wire rope to have an outside diameter which is less than the diameter of the core plus two strand diameters due to a phenomenon known as "nesting." The nesting factor is the result of minor changes in the geometry of the core and strands as the strands are wound about the core and various other reasons all of which are well known to those skilled in the wire rope art.

We claim:

1. A method of making a wire rope comprising the steps of:

lubricating a wire core;

impregnating said core with a thermoplastic material to retain said lubricant in said core, said thermoplastic material forming a jacket around said core, the outside diameter of said jacket being greater than the outside diameter of said core;

forming a plurality of strands about said jacket; and forcing said strands radially inwardly into said jacket thereby forcing said thermoplastic material to flow radially outwardly into the interstices between said core and said strands and between adjacent strands, said thermoplastic material flowing outwardly to a point less than the outside diameter of said rope, and said thermoplastic material forming a spacing between said strands and said core and between adjacent strands to hold said strands in a predetermined relationship to said core and to each other.

2. The method as defined in claim 1 further characterized by heating said jacket prior to forming said strands about said jacket.

3. The method as defined in claim 2 further characterized by forcing said strands into said heated jacket by drawing said rope through a die having an inside diameter of less than (J + 2S); where J is the outside diameter of said jacket, and S is the outside diameter of one of said strands.

4. The method as defined in claim 3 further characterized in that the inside diameter of said die is greater than 0.985 (C + 2S) and less than 1.03 (C + 2S); where C is the outside diameter of said wire core.

5. The method as defined in claim 1 further characterized by forcing said strands into said jacket by cold forming, thereby causing said thermoplastic material to cold flow radially outwardly into the interstices between said core and said strands.

6. The method as defined in claim 5 further characterized in that said rope is cold formed to an outside diameter of greater than 0.985 (C +2S) and less than 1.03 (C + 2S); where C is the outside diameter of said wire core, and S is the outside diameter of one of said strands.

7. A wire rope comprising: a lubricated wire core; a plurality of wire strands laid around said core to define a wire rope of predetermined outside diameter; and a thermoplastic material filling the interstices between said core and said strands and between adjacent strands, said thermoplastic material forming a spacing between said strands and said core and between adjacent strands to hold said strands in a predetermined relationship to said core and to each other, said thermoplastic material extending radially outwardly to a point less than the outside diameter of said rope.

8. A wire rope as defined in claim 7 wherein said core is a wire strand core.

9. A wire rope as defined in claim 7 wherein said core is an independent wire rope core.

10. A wire rope as defined in claim 7 wherein said strands have been forcibly embedded in said core, said strands having crown wires which lie on said predetermined outside diameter of said rope.

11. A wire rope as defined in claim 10 wherein said outside diameter is greater than 0.985 (C + 2S) and less than 1.03 (C + 2S); where C is the outside diameter of said core, and S is the outside diameter of one of said strands.

12. A wire rope comprising:

a lubricated wire core, the wires of said core, having a substantially round cross section;

a plurality of strands laid around said core, each of said strands having a generally round cross section and having crown wires which are deformable so as to lie on the outside diameter of said rope; and a thermoplastic material filling the interstices between said core and said strands and between adjacent strands to hold said strands in a predetermined relationship to said core and to each other, said thermoplastic material extending radially outwardly to a point less than the outside diameter of said rope.

13. A wire rope as defined in claim 12 wherein said core is a wire strand core.

14. A wire rope as defined in claim 12 wherein said core is an independent wire rope core.

15. A wire rope as defined in claim 12 wherein said outside diameter is greater than 0.985 (C + 2S) and less than 1.03 (C + 2S); where C is the outside diameter of said core, and S is the outside diameter of one of said strands.

16. A wire rope comprising: a wire core containing a lubricant encapsulated by a generally cylindrical plastic jacket of greater outer diameter than said wire core; and a plurality of strands laid about and embedded in said plastic jacket to provide a wire rope of a predetermined outer diameter; said plastic jacket forming a spacing between said strands and said core and between adjacent strands to hold said strands in a predetermined relationship to said core and to each other, said outer diameter of said jacket being disposed between said strands and being displaced outwardly of said wire core and inwardly of said outer diameter of said wire rope.

17. A wire rope as defined in claim 16 wherein said core is a wire strand core.

18. A wire rope as defined in claim 16 wherein said core is an independent wire rope core.

19. A method of making a wire rope comprising the steps of:

lubricating a wire core;

impregnating said core with a thermoplastic material to provide a generally cylindrical plastic jacket about said core, said jacket having a greater outside diameter than said core;

laying a plurality of strands about said jacket; and forcing said strands radially inwardly into said jacket to form a rope of a predetermined outer diameter thereby causing said thermoplastic material of said jacket to be flowably displaced outwardly between said strands to a location inwardly of said predetermined outer diameter of said rope, said jacket maintaining a predetermined relationship between said core and said strands.

* * * * *